US006471004B2

(12) United States Patent
Stringer et al.

(10) Patent No.: US 6,471,004 B2
(45) Date of Patent: Oct. 29, 2002

(54) SELF LOCKING BASKET ASSEMBLY

(75) Inventors: Matthew D. Stringer, Archbold, OH (US); Jason C. Pickles, Adrian, MI (US)

(73) Assignee: bil-jax, inc., Archbold, OH (US)

( * ) Notice: Subject to any disclaimer, the term of this patent is extended or adjusted under 35 U.S.C. 154(b) by 0 days.

(21) Appl. No.: 09/774,494

(22) Filed: Jan. 31, 2001

(65) Prior Publication Data

US 2002/0100637 A1 Aug. 1, 2002

(51) Int. Cl.[7] ..... E04G 1/18
(52) U.S. Cl. ..... 182/148; 182/113; 182/141
(58) Field of Search ..... 182/62.5, 63.1, 182/69.1, 2.7, 19, 113, 141, 148

(56) References Cited

U.S. PATENT DOCUMENTS 4,252,492 A * 2/1981 Scothern ..... 414/541
4,498,823 A * 2/1985 Trautman ..... 410/84
4,641,385 A * 2/1987 Peters et al. ..... 5/82
4,697,306 A * 10/1987 Rhodes ..... 16/317
4,799,447 A * 1/1989 Hebert et al. ..... 114/362
4,932,176 A 6/1990 Roberts et al.
4,949,410 A * 8/1990 Failor et al. ..... 5/430
4,987,976 A 1/1991 Daugherty
5,111,907 A 5/1992 Kishi
5,203,425 A 4/1993 Wehmeyer
5,273,132 A 12/1993 Sasaki et al.
D347,720 S 6/1994 Tamura et al.
D347,917 S 6/1994 Bedsole
5,333,766 A * 8/1994 Fisher ..... 224/42.21
5,337,858 A 8/1994 Neubauer
5,425,433 A 6/1995 Huber
5,487,446 A 1/1996 Patnode et al.
5,515,945 A 5/1996 Smith et al.
5,584,363 A 12/1996 Curtin et al.
5,657,834 A 8/1997 Plaugher et al.
5,683,214 A * 11/1997 Jeffreys ..... 410/77
5,722,505 A 3/1998 Grabner et al.
5,755,306 A 5/1998 Kraemer et al.
5,803,204 A 9/1998 White et al.
D399,628 S 10/1998 Smith
5,850,892 A 12/1998 Citron et al.
5,875,869 A 3/1999 Busuttil et al.
5,890,559 A 4/1999 Busuttil et al.
5,927,440 A * 7/1999 Freeman ..... 187/270
6,032,985 A * 3/2000 Cutter ..... 292/92
6,152,264 A * 11/2000 Gaines, Sr. et al. ..... 182/141 X

* cited by examiner

*Primary Examiner*—Bruce A. Lev
(74) *Attorney, Agent, or Firm*—Emch, Schaffer, Schaub & Porcello Co., L.P.A.

(57) ABSTRACT

A self locking basket assembly has a basket extending from a base platform, and a gate system for releaseably securing a worker within the cage. The gate system includes a gate operatively mounted on a pivotable locking mechanism. The locking mechanism is opened by moving the gate in a rearward direction at an angle to a plane defined by the base platform and thereafter pivoting the gate about a hinge mechanism to an open position.

18 Claims, 4 Drawing Sheets

SELF LOCKING BASKET ASSEMBLY

FIELD OF THE INVENTION

This invention is directed to a self locking aerial platform/basket assembly and more specifically, an aerial platform basket assembly for use with personnel lifts that are manually transportable between locations and can be readily set up.

BACKGROUND OF THE INVENTION

Personnel lifts are used for many applications. The personnel lifts generally have aerial work platforms/basket assemblies which are raised or lowered to position a worker at a desired height. The aerial platforms are used to gain access to overhead lighting fixtures, heating and air conditioning ducts, ceilings and the like.

The personnel lift typically includes the aerial work platform surrounded a personnel cage or basket in which the worker stands. The aerial platform and personnel basket are attached to a vertical lift, or mast assembly. The vertical mast assembly includes multiple extendable nested sections mounted on the base. The personnel lift also includes a device that stabilizes the personnel lift when the personnel basket assembly is in an elevated position.

The personnel lift is transportable by the worker to a desired location. After the personnel lift is securely stabilized, the worker enters the personnel basket and operates controls to raise and lower the aerial platform.

The worker using the aerial platform often moves the personnel lift to several different overhead locations in the course of one day. The worker must move the personnel lift from one location to another because the worker is limited to working in an area in which is within an arm's reach of the aerial platform. When the worker desires to do work beyond that reach, the worker must lower the aerial platform, unlock the personnel basket, exit the personnel basket, release the device stabilizing the platform, and move the personnel lift to the next desired location. The worker repeats the process of securing and stabilizing the personnel lift, entering the basket, locking the basket, raising the basket to the desired height, and performing the necessary work.

Each time the worker exits and enters the basket, the basket must be unlocked and then relocked and resecured. Since the personnel lift raises the aerial basket to relatively high heights, it is especially important to protect the worker in the basket. The basket must have a good locking mechanism which cannot be inadvertently unlocked or opened by the worker when the basket is in a raised position.

Often, the worker enters the basket with tools and/or parts to be installed. The worker often has difficultly stepping into the basket while maintaining his balance and simultaneously protecting the tools and parts he is carrying. It is therefore important the worker has free access to enter the basket, easily lock or secure the basket, and then to move about the basket when performing work at the elevated height.

Therefore, there is a need in the industry for a cage or basket assembly having a self locking design to prevent a worker from inadvertently opening the basket or cage.

There is a further need for a self locking aerial basket which allows a worker to readily enter the basket without having to step over barriers or duck under sections of the basket.

There is a further need for an aerial basket assembly which provides easy access to a work area by the worker without any obstacles to the worker's freedom of movement or ease in moving his arms, tools and/or parts to be installed.

It is therefore an object of this invention to provide a self locking basket assembly which is useful in many applications, and, in particular, for use in a personnel lift assembly which is easily operated and which provides both freedom of movement and security to the worker in the basket.

SUMMARY OF THE INVENTION

In accordance with the present invention, a self locking aerial basket assembly is provided. The basket assembly is especially useful with personnel lift systems. It should be understood that the self locking aerial basket assembly can be used in connection with other systems where a worker needs to be in a secured position yet have easy access to a worksite. For ease of explanation, the present invention will be described in connection with the basket assembly for a personnel lift. However, it should be understood that the personnel basket assembly of the present invention is also useful in other applications and such applications are also within the scope of the present invention.

The personnel lift includes a base having a plurality of rotatable wheels on the base. The base includes a stabilizing system such that the personnel lift is securely stabilized on any type of surface. The personnel lift further includes a mast assembly operatively mounted to the base. The mast assembly comprises a plurality of mast sections which are nested together when the mast is in a collapsed or closed, position and which are extended in a vertical direction when the mast is in an open, or raised, position.

The personnel lift includes a basket, or cage, assembly operatively connected to the mast assembly for supporting a worker. The basket assembly has a platform which is easily accessible by the worker and sides which extend from the platform. At least one of the sides of the basket includes a pivotable gate and locking mechanism which allows the worker to move the gate from a closed, or locked, position to an open, or unlocked, position. Once the worker is in the basket and the gate is pivoted to a closed position, the gate slidably moves into a locked position. The worker can lean against the gate without having the gate open. In order to open the gate, the worker must first move the gate in an upwardly and rearwardly direction and then pivot the gate along a diagonal axis.

DETAILED DESCRIPTION OF THE PREFERRED EMBODIMENT

Figure 1:
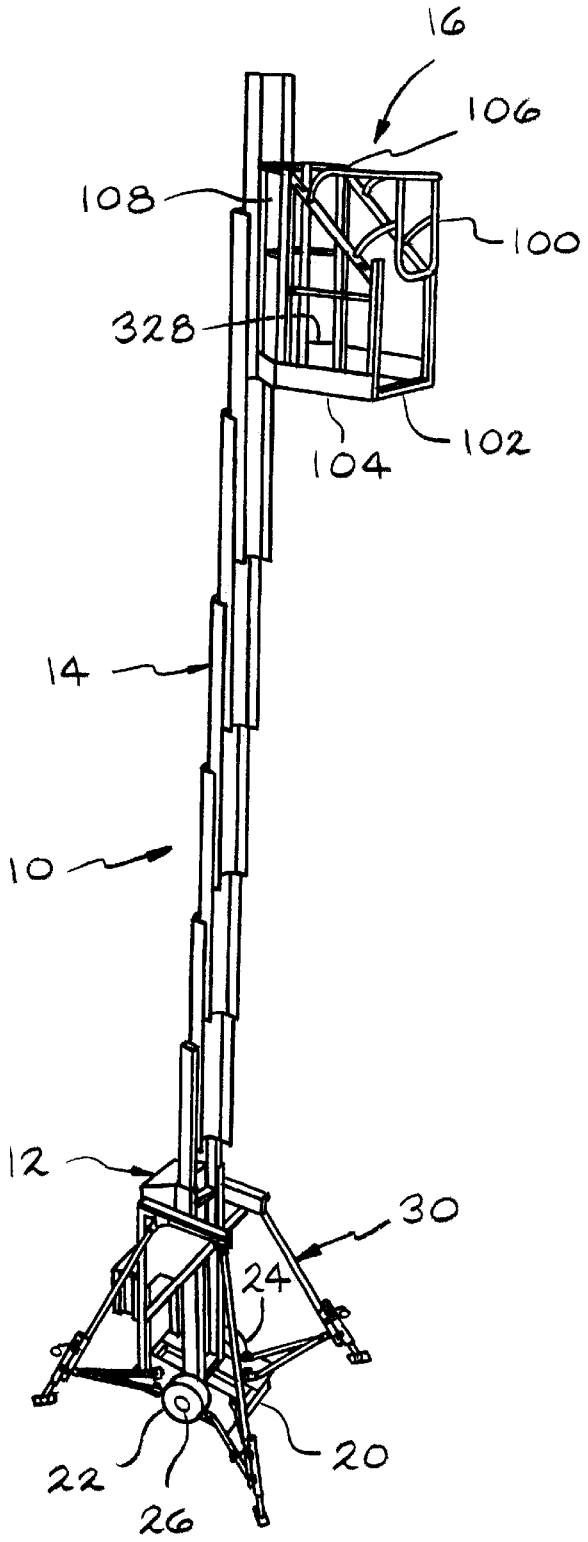
FIG. 1 is a perspective view of a personnel lift with a personnel basket in a raised position.

A personnel lift 10 includes a base assembly 12, a lift or mast assembly 14 mounted to the base assembly 12, and a basket assembly 16 operatively connected to the mast assembly 14.

The base assembly 12 includes a base 20 where the mast assembly 14 is preferably mounted at substantially the center of the base 20. The base 20 includes a pair of opposed wheels 22 and 24 which are mounted on an axle 26.

The base assembly 20 includes a plurality of stabilizing outrigger devices 30. In the embodiment shown, the personnel lift has four outrigger stabilizing systems 30, one mounted at each opposing corner of the base 20. However, it should be understood that in certain embodiment that either fewer or more outrigger systems 30 can be utilized to provide stability to the personnel lift 10. The stabilizing system is fully described in the copending application by the same inventor in the Ser. No. 09/774,853 which is expressly incorporated herein by reference.

The basket assembly 16 generally includes a gate system 100 and a base platform 102. The basket assembly 16 generally has a front side which is defined by the gate system 100, opposing sides 104 and 106 and a back 108. The gate system 100 is operatively mounted to the opposing sides 104 and 106. The opposing sides 104 and 106 and the back 108 are operatively mounted on the base platform 102. In a preferred embodiment, the opposing sides 104 and 106 and back 108 generally include a plurality of tubular structures, as shown in the figures. However, it is within the contemplated scope of the present invention that other configurations of the sides and back of the basket assembly are contemplated as being useful to protect and restrain a worker from accidentally falling from the basket assembly, and that such other configurations are within the contemplated scope of the present invention. For example, the opposing sides 104 and 106 and for the back 108 can be made of sheets of metal and/or plastic materials, such as those seen in many types of outdoor aerial platforms.

Figure 2:
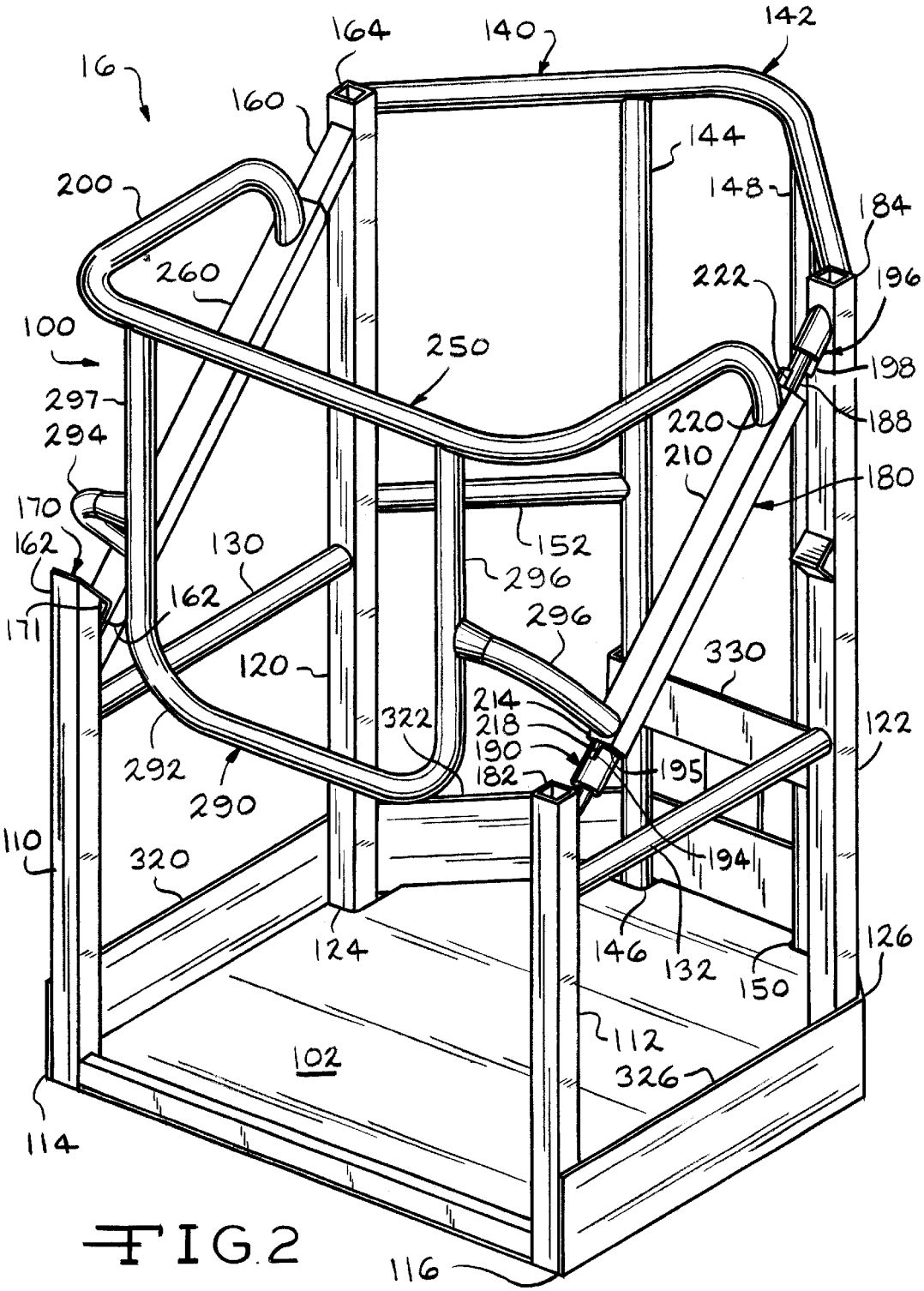
FIG. 2 is a perspective view of a personnel basket in a closed and locked position.

Referring now to the embodiment shown in FIG. 2, the first side 104 and the second side 106 of the basket assembly 16 generally include front first and second opposed generally vertically extending support members 110 and 112, respectively. The front support members 110 and 112 extend from the platform 102 at front platform corners 114 and 116, respectively, of the platform 102. A pair of midpoint first and second opposed generally vertically extending support members 120 and 122, respectively, extend from opposing midpoint platform corners 124 and 126, respectively. The front support members 110 and 112 and the midpoint support members 120 and 122 generally extend in a perpendicular direction from the platform 102 and are parallel to each other.

In the basket assembly comprised of tubular structures, the first front vertically extending support member 110 is connected to the first midpoint vertically extending support member 120 by one or more bars 130. Similarly, the second front vertically extending support member 112 is connected to the second midpoint vertically extending support member 122 by one or more bars 132. It is to be understood that more than one bar 130 and 132 can be positioned between each of the front support members 110 and/or 112 and the midpoint support members 120 and/or 122 and that such other numbers of bars 130 and 132 are within the contemplated scope of the present invention.

The back 108 of the basket assembly includes a rear bar 140 which extends in a rearward direction the first midpoint support member 120 and toward the second midpoint support member 122. In the embodiment shown, the rear bar 140 defines a curved distal section 142. A first rear vertically extending support member 144 extends from the rear bar 140 in a downward direction and connects with the platform 102 at a first distal corner 146. A second rear vertically extending support member 148 also extends from the rear bar 140 in a downward direction and terminates at a second distal corner 150 on the platform 102.

The first midpoint vertically extending support member 120 is connected to the rear support member 144 by one or more bars 152. Similarly, the second midpoint vertically extending support member 122 is connected to the second rear vertically extending support member 148 by one or more bars 1 54. It is to be understood that either fewer or more bars 152 and 154 can be positioned between the midpoint support members 120 and/or 122 and the rear support members 144 and/or 146 and that such other numbers of bars are within the contemplated scope of the present invention.

The gate system 100 is operatively mounted to the first and second sides 104 and 106. The gate system 100 includes at least one angled side bar 160 operatively mounted on the first side 104 which extends at an upward and rearward angle from a second end 162 of the first front support member 110. The angled side bar 160 terminates at a second end 164 of the midpoint first support member 120. Operatively attached to the second end 162 of the first front support member 110 is a latch member 170. The latch member 170 defines an angled surface 171 which is parallel to the angled bar 160.

The gate system further includes at least one self locking hinge member 180 operatively mounted on the second side 106 which extends from a second end 182 of the second front support member 112. The self locking hinge member 180 extends in a rearward and upward direction from the second end 182 of the second front support member 112. The hinge member 180 terminates at a second end 184 of the second midpoint support member 122.

The hinge member 180 includes a hinge pin 188 member, a locking member 190, and a pivoting member 210. The hinge pin 188 extends from the second end 182 of the second front support member 112 and terminates adjacent the second end 184 of the second midpoint support member 122. The locking member 190 is generally coaxially positioned around at least a section of the hinge pin 188 that is adjacent the first end 182 of the second front support member 112. The locking member 190 defines a locking member notch 194 that extends around at least a portion of the circumference of the locking member 190.

The hinge member 180 can further include a stop mechanism 196 which is positioned adjacent the second end 184 of the second midpoint support member 122. The stop mechanism 196 is coaxially positioned on the hinge pin 188. The stop mechanism 196 defines a stop mechanism notch 198 that extends around at least a portion of the circumference of the stop mechanism 196. In the embodiment show, the locking member notch 194 is shown as being positioned at approximately a 90° angle with respect to the stop mechanism notch 198.

The gate system 100 further includes a gate 200 which is connected to the hinge member 180. The gate 200 includes a pivoting member 210 which is coaxially positioned on the hinge pin 188. The pivoting member 210 has a first end 214 which is adjacent the locking member 190. The first end 214 defines a first gate notch 218 that extends around at least a section of the circumference of the first end 214 of the pivoting member 210. The first gate notch 218 engages the locking member notch 194 in the locking member 190 when the gate 200 is in a closed position.

The pivoting member 210 has a second end 220 which defines a second gate notch 222 that extends around at least a section of the second end 220. The second gate notch 222 engages the stop mechanism notch 198 in the stop mechanism 196 when the gate 200 is in an open position. The locking member notch 194 is coaxially positioned on the hinge pin 188 at an angle with respect to the first gate notch 218.

Figure 3:
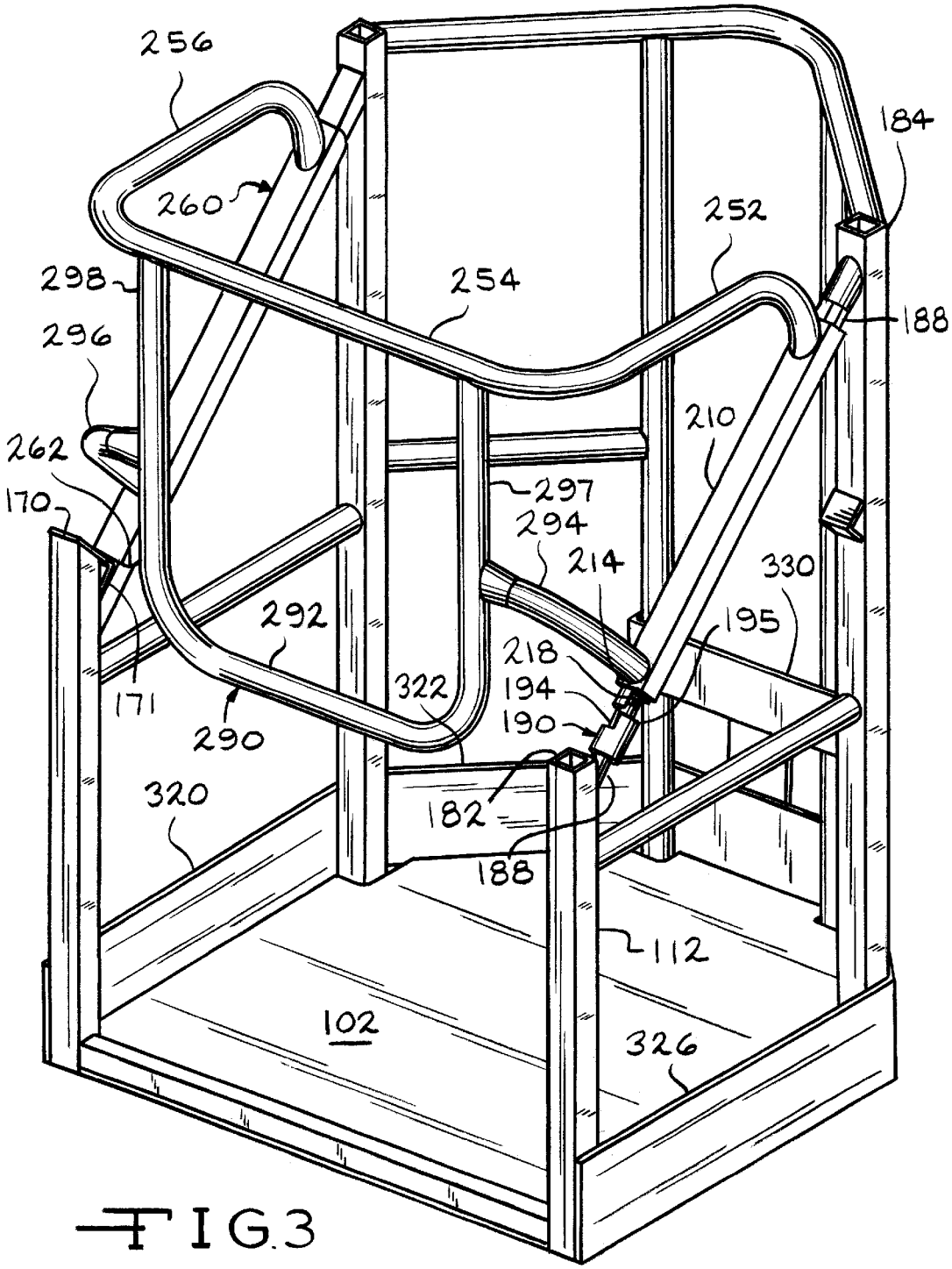
FIG. 3 is a perspective view of a personnel basket in a closed and unlocked position.

In order to open the basket assembly 16, the gate 200 is moved in an upward and rearward direction about the hinge pin 188. The pivoting member 210 of the gate 200 is axially moved along the hinge pin 188 in an upward and rearward direction such that the first gate notch 218 on the first end 214 of the pivoting member 210 axially moves to a distance beyond an end point of the locking member notch 194 in the locking mechanism 190, as best seen in FIG. 3.

Figure 4:
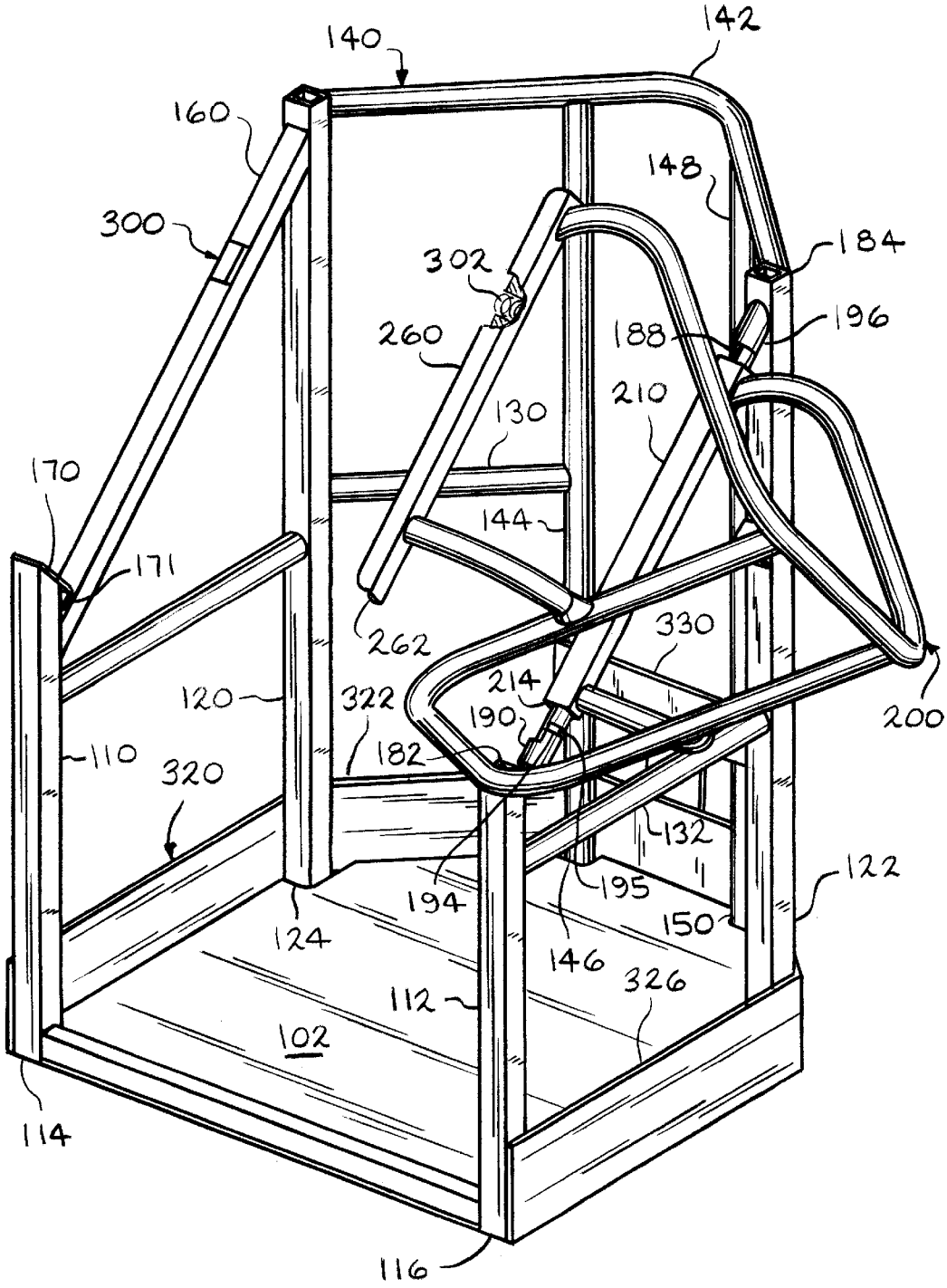
FIG. 4 is a perspective view of a personnel basket in an open position.

Thereafter, the pivoting member 210 of the gate 200 is pivoted about the hinge pin 188 such that the gate 200 swings to an open position, as seen in FIG. 4.

As the gate 200 is pivoted about the hinge pin 188, the second gate notch 222 in the second end 220 of the pivoting member 210 engages the stop mechanism notch 198 in the stop mechanism 196. The gate 200 is held in an open position and is prevented from axially sliding in a downward and forward direction by a camming mechanism; i.e., the contact of the first gate notch 218 in the first end 214 of the pivoting member 210 with a distal end 195 of the locking mechanism 194, as best seen in FIG. 4.

When the gate 200 is to be closed, the gate 200 is pivoted about the hinge 188 so that the pivoting member 210 both axially and circumferentially moves along the pivot pin 188 in a forward and downward direction. The locking member notch 194 and the first gate notch 218 come into mating engagement such that the gate 200 cannot be opened or pivoted about the hinge pin 188. In order to open the gate 200, the worker must actively both lift and pivot the gate 200 in a rearward direction about the pivot pin 188.

The gate 200 further includes a front restraining bar 250 which extends from the second end 220 of the pivoting member 210 and terminates at a locking bar 260. In the embodiment shown, the front restraining bar 250 has a generally curved shape and includes a first front extending member 252, a generally horizontally extending front member 254, and a rearwardly extending horizontal section 256.

The locking bar 260 is in an opposed and parallel relationship to the hinge pin 188. That is, the locking bar 260 is positioned at the same angle with respect to a plane defined by the base 102 as the hinge pin 188. In the embodiment shown in FIG. 4, the locking bar 260 defines a generally U or open channel shape; however, it should be understood that the locking bar 260 can have a different suitable shape which aids in locking the gate 200 to the basket assembly 16. The locking bar 260 matingly engages the angled side bar 160 when the gate 200 is in a closed position. A first end 264 of the locking bar 260 matingly engages the angled surface 171 of the latching mechanism 170 when the gate 200 is in a closed position.

The gate 200 can further include one or more front restraining sections 290 which extend from the front restraining bar 250. The restraining section 290 generally prevents a worker from falling out of the basket assembly 16 when the worker is in a crouched or kneeling position. In the embodiment shown, the restraining section 290 includes a generally U-shaped member 292 which extends in a vertically downward direction from the horizontally extending front member 250. One or more side brace members 294 and/or 296 can extend from legs 297 and 298 of the U-shape member 292 and terminate at the pivoting member 210 and the locking bar 260, respectively. It is to be understood that other configurations of the restraining section 290 are within the contemplated use of the present invention.

In order to open the basket assembly 16, the worker grasps the gate 200 or the restraining bar 250 and moves the gate 200 and restraining bar 250 in an upward and rearward direction. The first end 262 of the locking bar 260 is slideably moved along the angled side bar 160 such that the locking bar 260 clears the angled surface 171 of the latching mechanism 170. Simultaneously, the upward and rearward movement of the gate 200 causes the first gate notch 218 to clear the locking member notch 194 of the locking member 190. The worker rotates the gate 200 about an axis defined through the hinge pin 188 such that the gate 200 is swung open. As shown in FIG. 4, the gate 200, now in an open position, rests in an open position.

As shown in FIG. 4, a sensing mechanism 300 can be operatively mounted in the angled side bar 160 such that the worker will be given a signal that the latching mechanism 170 is closed and the basket assembly 16 can then be raised by the personnel lift. The sensing mechanism 300 can include any suitable latching or sensing mechanism such as a corresponding triggering mechanism 302 operably mounted within the U-shaped channel defined by the locking bar 260. The sensing mechanism 300 is activated by the triggering mechanism 302 when the locking bar 260 is fully engaged on the angled side bar 160 and when a first end 262 of the angled side bar 260 is adjacent or in contact with the latching member 170 on the first front vertically extending support member 110.

The present invention allows the worker to enter the basket assembly 16 and step onto the platform 102 without having to step over any barriers. In the embodiment shown in the Figures, the basket assembly 16 has a first bottom support member 320 which extends from the first front vertically extending support 110 to the first midpoint vertically extending support member 120, and a second bottom support member 322 which extends from the first midpoint support 120 to the first rear vertically extending support member 144. Similarly, a third bottom support member 326 extends from the second front vertically extending support member 112 to the second midpoint vertically extending support member 122. A fourth bottom support member 328 extends between the second midpoint vertically extending support member 122 and the second rear vertically extending support member 148. A fifth bottom support member 330 extends between the rear support members 144 and 148. The fifth bottom support member 330 provides a mounting space so that the basket assembly 16 can be equipped with control equipment (not shown) and the like.

Although the present invention has been described with respect to its preferred embodiments, those skilled in the art will recognize changes which may be made in the aforementioned structure which do not depart from the spirit of the invention already described in the specification and embodied in the following claims.

We claim:

1. A self locking basket assembly (16) for a personnel lift comprising a base platform (102), and a gate system (100) for releaseably securing a worker within the basket assembly, the gate system (100) including a gate (200) operatively mounted on a pivotable self locking mechanism (180), the locking mechanism (180) including a hinge pin (188), a locking member (190) coaxially positioned around at least a section of the hinge pin (188), and a pivoting member (210) coaxially positioned on the hinge pin (188), the locking member (190) including a locking member notch (194) which is in mating engagement with a first gate notch (218) on the pivoting member (210) when the gate (200) is in a closed position, whereby the pivoting member (210) is capable of axially and circumferentially pivoting on an axis that is on an angle to both the horizontal and vertical along the pivot pin (188), and whereby the locking member (190) is disengaged when a vertical and horizontal force is applied to the pivoting member (210).

2. The self locking basket assembly of claim 1, wherein a stop mechanism (196) is adjacent a second end of the hinge member (180), the stop mechanism (196) being in mating engagement with a second gate notch (222) on the pivoting member (210) when the gate (200) is in the open position.

3. The self locking basket assembly of claim 2, wherein the second gate notch (222) engages a stop notch (198) in the stop mechanism (196), when the gate (200) is in the open position.

4. The self locking basket assembly of claim 1, wherein the second gate notch (222) is positioned on the pivoting member (210) at an angle with respect to the first gate notch (218) on the pivoting member (210).

5. The self locking basket assembly of claim 4, wherein the locking member (190) is coaxially positioned on the hinge pin (188) at an angle with respect to the second gate notch (222).

6. The self locking basket assembly of claim 1, wherein the gate system (100) further includes a restraining bar (250) which terminates at a locking bar (260), the locking bar (260) being positioned in an opposed and parallel relationship to the hinge pin (188) of the gate (200), the locking bar (260) being positioned at substantially the same angle with respect to the base platform (102) as the hinge pin (188).

7. The self locking basket assembly of claim 6, wherein the locking bar (260) matingly engages a side bar (160) of the gate system (100) when the gate (200) is in the closed position.

8. The self locking basket assembly of claim 7, wherein the side bar (160) of the gate (100) includes a sensing mechanism (300) for indicating when the gate (200) is in the closed and locked position.

9. The self locking basket assembly of claim 8, wherein the sensing mechanism (300) is triggered by a triggering mechanism (302) on the locking bar (260) when the locking bar (260) is fully engaged on the side bar (160) and a first end (262) of the locking bar (260) is adjacent or in contact with a latching mechanism (170) on the basket assembly (16).

10. A personnel lift (10) comprising a base (12), a lift assembly (14) attached to the base (12) and capable of extending along a vertical axis and having an upper end, an basket assembly (16) extending from the base platform (102), and a gate system (100) for releaseably securing a worker within the basket assembly, the gate system (100) including a gate (200) operatively mounted on a pivotable locking mechanism, the locking mechanism (180), the locking mechanism (180) including a hinge pin (188), a locking member (190) coaxially positioned around at least a section of the hinge pin (188), and a pivoting member (210) coaxially positioned on the hinge pin (188), the locking member (190) including a locking member notch (194) which is in mating engagement with a first gate notch (218) on the pivoting member (210) when the gate (200) is in a closed position, whereby the pivoting member (210) is capable of axially and circumferentially pivoting on an axis that is on an angle to both the horizontal and vertical along the pivot pin (188), and whereby the locking member (190) is disengaged when a vertical and horizontal force is applied to the pivoting member (210).

11. The personnel lift of claim 10, wherein a stop mechanism (196) is adjacent a second end of the hinge member (180), the stop mechanism (196) being in mating engagement with a second gate notch (222) on the pivoting member (210) when the gate (200) is in the open position.

12. The personnel lift of claim 11, wherein the second gate notch (222) engages a stop notch (198) in the stop mechanism (196) when the gate (200) is in the open position.

13. The personnel lift of claim 10, wherein the second gate notch (222) is positioned on the pivoting member (210) at an angle with respect to the first gate notch (218) on the pivoting member (210).

14. The personnel lift of claim 13, wherein the locking member (190) is coaxially positioned on the hinge pin (188) at an angle with respect to the second gate notch (222).

15. The personnel lift assembly of claim 10, wherein the gate system 100 further includes a restraining bar (250) which terminates at a locking bar (260), the locking bar (260) being positioned in an opposed and parallel relationship to the hinge pin (188) of the gate (200), the locking bar (200) being positioned at substantially the same angle with respect to the base platform (102) as the hinge pin (188).

16. The personnel lift of claim 15, wherein the locking bar (260) matingly engages a side bar (160) of the gate system (100) when the gate (200) is in the closed position.

17. The personnel lift of claim 16, wherein the side bar (160) of the gate (200) includes a sensing mechanism (300) which for indicating when the gate (200) is in the closed and locked position.

18. The personnel lift of claim 17, wherein the sensing mechanism (300) is triggered by a triggering mechanism (302) on the locking bar (260) when the locking bar is fully engaged on the side bar (160) and a first end (262) of the locking bar (260) is adjacent or in contact with a latching mechanism on the basket assembly (16).

* * * * *